US008356545B2

(12) United States Patent
Stellwagen

(10) Patent No.: US 8,356,545 B2
(45) Date of Patent: Jan. 22, 2013

(54) LOAD-SENSING (LS) CONTROL SYSTEM

(75) Inventor: Armin Stellwagen, Lohr (DE)

(73) Assignee: Robert Bosch GmbH, Stuttgart (DE)

( * ) Notice: Subject to any disclaimer, the term of this patent is extended or adjusted under 35 U.S.C. 154(b) by 1000 days.

(21) Appl. No.: 12/377,759

(22) PCT Filed: Jul. 3, 2007

(86) PCT No.: PCT/EP2007/005859

§ 371 (c)(1),
(2), (4) Date: Feb. 17, 2009

(87) PCT Pub. No.: WO2008/025396

PCT Pub. Date: Mar. 6, 2008

(65) Prior Publication Data

US 2010/0236397 A1 Sep. 23, 2010

(30) Foreign Application Priority Data

Aug. 28, 2006 (DE) ..... 10 2006 040 234

(51) Int. Cl.
*F15B 11/04* (2006.01)

(52) U.S. Cl. ..... 91/446; 91/418

(58) Field of Classification Search ..... 91/418, 91/446, 448; 137/625.69

See application file for complete search history.

(56) References Cited

U.S. PATENT DOCUMENTS

| | | | | |
|---|---|---|---|---|
| 3,742,980 | A * | 7/1973 | Byers, Jr. | 137/625.62 |
| 4,981,159 | A | 1/1991 | Christensen et al. | |
| 6,179,393 | B1 * | 1/2001 | Stellwagen | 303/115.4 |
| 2004/0069359 | A1 * | 4/2004 | Buttner | 137/625.69 |

FOREIGN PATENT DOCUMENTS

| | | | |
|---|---|---|---|
| DE | 88 01 058 | | 3/1988 |
| DE | 38 02 672 | | 8/1989 |
| DE | 197 15 020 | | 10/1998 |
| DE | 101 07 532 | | 8/2002 |
| EP | 1 069 317 | | 1/2001 |
| EP | 1 452 744 | | 9/2004 |
| EP | 1452744 | A1 * | 9/2004 |

* cited by examiner

*Primary Examiner* — Thomas E Lazo
*Assistant Examiner* — Logan Kraft
(74) *Attorney, Agent, or Firm* — Michael J. Striker

(57) ABSTRACT

An LS control system is disclosed that includes an inlet metering orifice and a pressure compensator, via which the pressure drop across the inlet metering orifice may be held constant. The signalling pressure that acts on the pressure compensator in the opening direction may be varied as a function of the displacement in order to prevent the system from oscillating if a negative load should occur.

12 Claims, 4 Drawing Sheets

LOAD-SENSING (LS) CONTROL SYSTEM

CROSS-REFERENCE

The invention described and claimed hereinbelow is also described in PCT/EP2007/005859, filed on Jul. 3, 2007 and DE 10 2008 040 234.0, filed on Aug. 28, 2006. This German Patent Application, whose subject matter is incorporated here by reference, provides the basis for a claim of priority of invention under 35 U.S.C. 119 (a)-(d).

BACKGROUND OF THE INVENTION

The present invention relates to a load sensing (LS)control system for supplying pressure medium to a hydraulic consumer.

LS control systems of this type are used in particular to control hydraulic consumers of mobile working devices. DE 197 15 020 A1 discloses an LS control block in which a consumer is supplied with a pressure medium via an LS directional control valve. The proportionally adjustable, directional control valve includes a valve spool that, together with a valve housing, forms a directional part and speed part. Via the directional part, the supply and release of pressure medium to and from the consumer is controlled, while the speed part establishes the volumetric flow rate of the pressure medium. In the case of the known solution, the speed part is formed by an adjustable metering orifice, one of which is located in the inflow and the other of which is located in the outflow, the opening cross-section of which may be changed via the axial displacement of the valve spool. A pressure compensator is installed upstream of the inlet metering orifice at the least, the pressure compensator being acted upon in the opening direction by the force of a spring, and by a pressure which exists downstream of the inlet metering orifice and corresponds to the load pressure, and, in the closing direction, is acted upon by the pressure that exists upstream of the inlet metering orifice.

If an LS control system of this type will now be used to control a recipricating cylinder using a compressive load, a load-lowering valve is often assigned thereto on the outlet side. A load-lowering valve of this type is basically a blocking valve that may be released via the pressure in the inlet, and which enables load to be lowered in a controlled manner in the presence of a compressive load. It has been demonstrated that a system of this type that includes an LS control block and a load-lowering valve tends to oscillate under certain operating conditions. This susceptibility to oscillation results from the fact that the load-lowering valve is controlled by the pressure in the inlet, i.e. by the pressure that exists downstream of the inlet metering orifice. If this inlet pressure is not sufficient, the load-lowering valve is closed and the return is closed. The pressure in the inlet then increases once more, and the load-lowering valve opens—the pressure in the inlet is therefore dependent on the extent to which the load-lowering valve is open. This opening and closing of the load-lowering valve that occurs when a load is being lowered results in fluctuations in the inlet that affect the upstream pressure compensator and, possibly, the variable-displacement pump, which is controlled as a function of the effective load pressure.

This tendency to oscillate may be reduced under certain circumstances by tapping the signaling pressure that acts on the pressure compensator between a pressure divider having a constant nozzle and a variable-area propelling nozzle, which is located in a control channel that extends between the inlet and the outlet. A solution of this type is disclosed, e.g., in EP 1 452 744 A1, which is owned by the applicant.

DE 38 02 672 A1 describes an LS control system, in the case of which the signaling pressure that acts on the pressure compensator in the opening direction is also tapped between a fixed nozzle and a variable-area propelling nozzle, both of which are integrated in a valve spool of an LS directional control valve and an LS control system. This control channel is connected to the tank via the variable-area propelling nozzle. The nozzle cross section is reduced depending on the displacement of the valve spool, and the tapped signaling pressure that acts on the pressure compensator in the opening direction increases accordingly, thereby preventing the pressure compensator from being closed—which would be undesirable—when a compressive load is lowered as described above. In the solution described in DE 38 02 672 A1, the signaling pressure is tapped via a further control channel in a conventional manner downstream of the inlet metering orifice when the valve spool is displaced in the opposite direction, e.g. to raise the load. The control channels and nozzles described above are integrated in the valve spool in a manner such that they are very difficult to manufacture in terms of forming the nozzle cross-sections the connecting channels.

SUMMARY OF THE INVENTION

In contrast, the object of the present invention is to create a load sensing, or LS, control system that prevents a pressure compensator from accidentally closing, and that has a simple design.

According to the present invention, the LS control system includes a continually adjustable, directional control valve, via which metering orifices situated in the pressure medium inlet and/or the pressure medium outlet are formed. A pressure compensator is assigned to at least one of these metering orifices, and it is acted upon with a control pressure to increase the opening cross-section, the control pressure being tapped via an LS channel by a load-signaling chamber of the directional control valve. This load-signaling chamber is connected via a signaling sing channel to a pressure chamber that is connected to one of the direction-control valve connections, and it is connected via a nozzle to a pressure-medium recess. The nozzle opening cross-section may be changed as a function of the displacement of the directional control valve. The signaling channel is designed in a manner such that it is connectable, in one direction of reciprocation, to an inlet chamber that is connected to a pressure connection, and, in the other direction of reciprocation of the valve spool, it is connectable to a working chamber that is connected to a working connection.

In a design of this type, there is no need to provide a separate signaling channel for every direction of displacement of the valve spool in order to tap the control pressure that acts on the pressure compensator, thereby making it substantially easier to manufacture the LS directional control valve than, e.g., that which was explained with reference to FIG. 6 in DE 38 02 672 A1.

In a particularly preferred solution, when the valve spool of the directional control valve moves in one direction, the load-signaling chamber is situated in a pressure divider between an inlet-side throttle sequence and an outlet-side throttle sequence.

It is preferable for an outlet-side control fluid path of the pressure divider to include an axial bore having two radial bores in the valve spool, one of which may be opened toward the tank, and the other of which may be opened toward the load-signaling chamber.

The inlet-side control-fluid path of the pressure divider may be designed as a signaling bore having two radial bores in the valve spool, one of which includes an inlet chamber, and the other of which is open toward or may be opened toward the load-signaling chamber.

The pressure divider may be integrated in the valve spool particularly easily when the signaling bore of the inlet-side control-fluid path is situated in the center, and when an axial bore in the outlet-side control-fluid path is situated eccentrically in the valve spool.

In a preferred embodiment of the present invention, the connection of the load-signaling chamber is closed when displacement occurs in the direction of the valve spool that is opposite to that stated above, thereby preventing control oil from flowing out to the tank.

In a solution having a particularly simple design, the signaling channel is integrated in the valve spool, and it is formed, in sections, by a longitudinal bore in which at least two axially interspaced, radial tapping bores lead, one of which may be brought into a pressure medium connection with the inlet chamber depending on the direction of displacement, and the other of which may be brought into a pressure medium connection with the working chamber when displacement occurs in the opposite direction.

The design of the valve spool is simplified further when the two tapping bores are formed on a piston collar on which a control edge is formed for adjusting the opening cross-section of the metering orifice as a function of the displacement in the opposite direction.

This longitudinal bore is preferably connected via a radially extending nozzle bore to the LS chamber of the directional control valve.

In an advantageous development of the present invention, a first secondary chamber and a second secondary chamber are formed on either side of the load-signaling chamber, the first and second secondary chambers being connected to a first and second load-signaling channel, respectively, in each of which an LS pressure-limiting valve is preferably located. Via these pressure-limiting valves, it is possible to limit the control pressures—that act on the pressure compensator—in both directions of displacement.

The valve spool preferably includes two LS control edges, via each of which a connection may be opened between the load-signaling chamber and an adjacent secondary chamber, or closed to the other secondary chamber, so that only one of these secondary chambers is active, depending on the reciprocation. The valve spool may also be designed to include an LS control edge in order to open or close a connection between a tank chamber and the adjacent secondary chamber.

In a preferred embodiment, the pressure-medium connection to the pressure-medium recess (tank) is established via an axial bore that makes it possible, via at least one radial leg, to establish a pressure medium connection to a tank chamber, which is connected to a tank connection, and to one of the secondary chambers via a throttle cross-section that is changeable depending on the displacement, in particular a throttle groove.

The valve spool is particularly easy to manufacture when the longitudinal bore extends in the axial direction in the valve spool, and when the axial signaling bore extends axially parallel in the valve spool.

BRIEF DESCRIPTION OF THE DRAWINGS

A preferred embodiment of the present invention is explained below in greater detail with reference to schematic drawings.

DETAILED DESCRIPTION OF THE PREFERRED EMBODIMENTS

Figure 1:
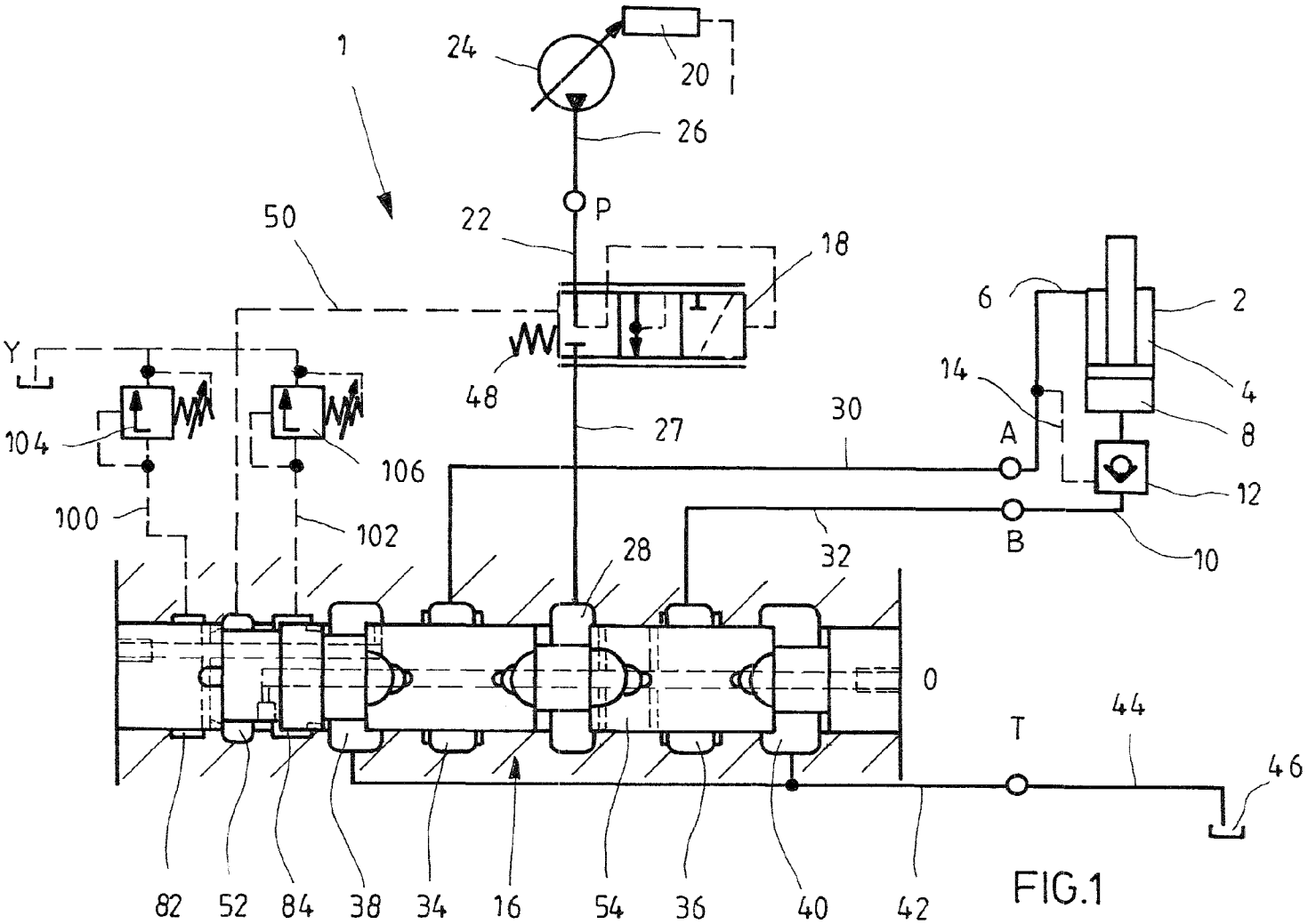
FIG. 1 shows a schematic of an LS control system according to the present invention, for supplying pressure medium to a hydraulic consumer.

The schematic of an LS control system shown in FIG. 1 may be designed, e.g., as a valve spool of a mobile control block for controlling the hydraulic consumer of a mobile working device, e.g., a folding arm of a truck-loading crane. An LS control system 1 of this type includes a pressure connection P, a tank connection T, and two working connections A, B, at least one drain Y, and an LS connection (not depicted). A consumer, which is a differential cylinder 2 in this case, is connected to working connections A, B; annular space 4 of differential cylinder 2 is connected via a working line 6 to connection A, and base-side cylinder chamber 8 of differential cylinder 2 is connected via a working line 10 to working connection B. A load-lowering valve 12 is situated in working line 10, it being possible to release load-lowering valve 12 using the pressure in working line 6 when differential cylinder 2 is retracted, thereby enabling pressure medium to flow out of cylinder chamber 8, which is becoming smaller. This control pressure for opening load-lowering valve 12 is tapped from working line 6 via a load-lowering line 14. Control system 1 is composed essentially of a continuously adjustable, 4-way directional control valve 16. A speed part is formed—as described in greater detail, below—by an inlet metering orifice, in the case of which a pressure compensator 18 is installed upstream of the LS system shown, via which the pressure drop may be held constant, independently of the load pressure, via the inlet metering orifice.

The highest load pressure of all consumers connected to the mobile control block is tapped via a cascade of directional control valves, and it is directed to a pump regulator 20, via which the pump pressure is set such that it lies above the highest load pressure of all consumers by a predetermined pressure differential.

In control system 1 according to the present invention, pressure compensator 18 is connected via its inlet connection to a pressure line 22, which is connected to pressure connection P of the control system, it being possible to supply pressure line 22 with pressure medium via a variable-displacement pump 24 and a pump line 26. Instead of the variable-displacement pump, it is also possible to use a constant pump that includes a bypass pressure compensator.

One outlet connection of pressure compensator 18 is connected via an inlet channel 27 to an inlet chamber 28 of directional control valve 16, which will be described in greater detail below. Working connections A, B are connected via a forward-flow channel 30 or a return channel 32 to a working chamber 34 or 36, respectively, working chamber 34 or 36 being connectable—depending on the setting of the directional control valve—to inlet chamber 28 or to two tank chambers 38, 40, which are connected via an outlet channel 42 to tank connection T, which is connected via tank line 44 to tank 46. Pressure compensator 18 is acted upon, to reduce its throttle cross-section, by pressure upstream of the metering orifice, i.e., by pressure in inlet channel 27, and, to increase the throttle cross-section, it is acted upon by the force of a control spring 48 and a control pressure which is tapped via an LS channel 50 from a load-signaling chamber 52 of directional-control valve 16.

The details of this directional control valve are explained below with reference to the enlarged view shown in FIG. 2.

Directional control valve 16 includes a valve spool 54 which is displaceably guided in a valve bore 56 of the valve spool of mobile control block. In the illustration shown in FIG. 2, valve spool 54 is preloaded via a centering spring system (not shown) in a central position in which the connection of working connections A, B to pressure connection P and tank connection T is blocked. Valve spool 54 includes five piston collars, which are separated from each other by annular grooves. They are, from left to right in the illustration shown in FIG. 2: an end collar 58, an LS collar 60, two control collars 62, 64, and a further end collar 66. A control edge which includes, e.g., two control grooves 68, is formed on left end collar 58. LS collar 60 adjacent thereto includes a first and second LS control edge 70, 72, respectively, the latter of which, at the least, includes control grooves, which are indicated using dashed lines. Control collar 62 shown at the left in FIG. 2 includes a tank control edge 74 and a metering orifice control edge 76, each of which includes fine-control notches. Accordingly, control collar 64 on the right also includes a metering orifice control edge 78 and a tank control edge 80. In addition to aforementioned pressure chambers 28, 34, 36, 38, 40, 52, valve bore 56 is expanded in the radial direction toward a first and second secondary chamber 82, 84, respectively, which are located to the left and right of load-signalling chamber 52. The load-signaling in load-signaling chamber 52 takes place via channels that are integrated in valve spool 54. According to the illustration shown in FIG. 2, valve spool 54 includes a signaling channel 86 that is drilled inward from right end collar 66, where it is blocked via a stopper. When directional-control valve 16 is in the central position shown, signaling channel 86 extends approximately to the region between load-signaling chamber 52 and right-hand secondary chamber 84, where it empties via a nozzle bore 88 that extends in the radial direction in the outer circumference of the annular groove that is situated between end collar 58 and LS collar 60; load-signaling chamber 52 is connected to secondary chamber 84 via the annular groove when valve spool 54 is in the central position shown. Overall, all three chambers 82, 52, and 84 are relieved of pressure in the direction toward tank chamber 38 when valve spool 54 is situated in the central position shown. In the region of second control collar 64, two axially interspaced tapping bores 90, 92 that extend approximately in the radial direction lead into signaling channel 86, tapping bores 90, 92 being formed by one or more diagonal bores. When valve spool 54 is situated in the central position, tapping bores 90, 92 are blocked by the segment between inlet chamber 28 and working chamber 36.

An axial bore 94 is formed starting at the end face of left-hand end collar 58 and extends in parallel with and at a distance from signaling bore 86; left-hand end section of axial bore 94 is also blocked by a stopper, and the opposite end section leads into tank chamber 38 via a radial leg 96, which forms a throttle when valve spool 54 is situated in the central position. At least one through-bore 97 leads into axial bore 94; throttle grooves 98 are formed in the end sections on the circumferential side of through-bore 97. Throttle grooves 98 open toward through-bore 97, and their effective throttle cross-section decreases toward the right, i.e. toward LS chamber 52. In the central position shown, the opening cross-section between secondary chamber 82 and LS chamber 52 is minimal or even blocked. In addition, in the central position shown, the two outlets of through-bore 97 open toward secondary chamber 82. Control groove 68 is designed in a manner such that, when valve spool 54 is in the central position shown, control groove 68 establishes a pressure medium connection between LS chamber 52 and left-hand secondary chamber 82, thereby connecting LS chamber 52 via secondary chamber 82, through-bore 97, axial bore 94, and radial bore 96 to tank chamber 38. Right-hand secondary chamber 84 is also connected to tank chamber 38 via control edge 72 and its control notches; tank pressure therefore exists in LS channel 50 (see FIG. 1), with the pressure release taking place via two fluid paths.

As shown in FIG. 1, left-hand secondary chamber 82 and right-hand secondary chamber 84 are connected to drain Y via a first load-signaling channel 100 and 102, respectively, and by an adjustable pressure-limiting valve 104 and 106, respectively.

When directional control valve 16 is situated in its central position shown in FIG. 1, pressure compensator 18 assumes the load-holding position shown, in which inlet channel 27 is blocked and the pump pressure acts against spring 48.

Figure 3:
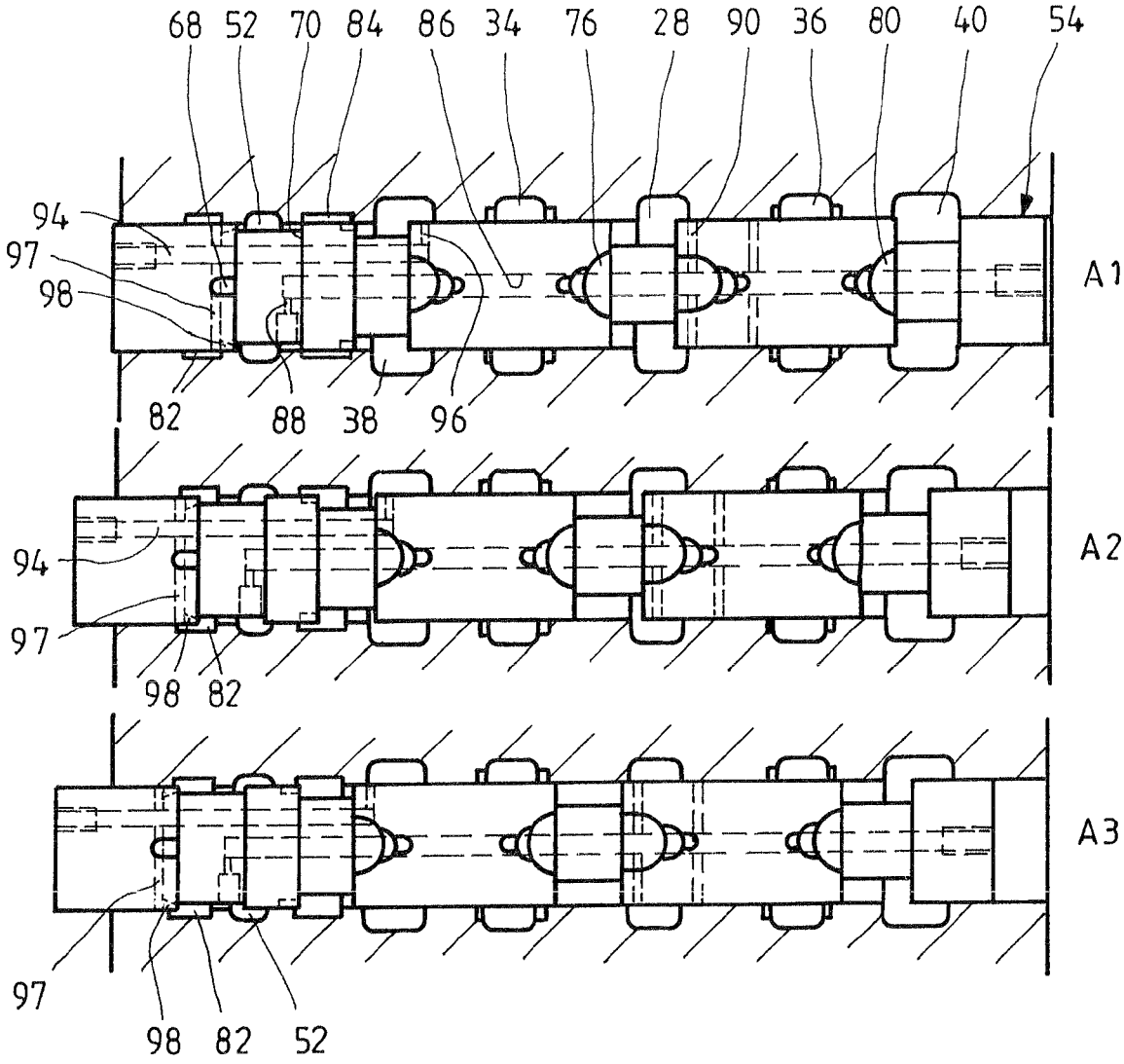
FIG. 3 shows the directional control valve in FIGS. 1 and 2 when displacement occurs in one direction.

To retract differential cylinder 2, valve spool 16 is displaced via a precontrol system (not depicted) to the left, e.g., into position A1 shown in FIG. 3. As a result, a metering orifice cross-section between inlet chamber 28 and working chamber 34 is opened via metering orifice control edge 76, thereby conveying pressure medium via forward-flow channel 30 into annular space 6 of differential cylinder 2. Load-lowering valve 12 is opened via the pressure in forward-flow channel 30, thereby allowing pressure medium to flow out of shrinking cylinder chamber 8 via working line 10, return channel 32, and the outflow cross-section between working chamber 36 and tank chamber 40, the outflow cross-section being opened by tank control edge 80.

Via the axial displacement of valve spool 54, tapping bore 90 is opened toward inlet chamber 28, thereby enabling the pressure in the inlet to be signaled in signaling channel 86 via tapping bore 90. When valve spool 54 is in position A1, the connection between secondary chamber 84 and load-signaling chamber 52 is blocked via LS control edge 70, load-signaling chamber 52 being connected to signaling channel 86 via nozzle bore 88, however. Load-signaling chamber 52 is connected via control groove 68 to left-hand secondary channel 82, which is connected via through-bore 97 to axial bore 94, which opens toward tank chamber 38 via radial leg 96. When valve spool 54 is in position A1, the effective throttle cross-section of secondary chamber 82, toward which load-signaling chamber 52 is open, is at a maximum through bores 97, 94 and 96, so that a relatively small load pressure is tapped between throttle cross-sectional sequences 90, 86, 88 and 97, 94, 96, and is signaled via load-signaling chamber 52 and LS channel 50 to spring-side control surface of pressure compensator 18, which is effective in the opening direction. This adjusts a pressure in inlet channel 27 that is higher than the tapped pressure by the pressure equivalent of spring 48.

When valve spool 54 is displaced further to the left (position A2 in FIG. 3), through-bore 97 gradually becomes covered after a certain partial displacement (constant signaling pressure), so that the effect of outlet-side throttle sequence 97, 94, 96 increases, and the load-signaling pressure in load-signaling chamber 52 rises. Finally, through-bore 97 itself is closed, and it is connected to secondary chamber 82 only via the throttle grooves. Throttle grooves 98 are designed such that the throttle cross-section becomes smaller as the displacement increases, thereby varying the signaling pressure that acts on pressure compensator 18 accordingly. In the maximum end position of valve spool (A3 in FIG. 3), the remaining cross section of throttle grooves 98 determines the pressure in secondary chamber 82 and, correspondingly, in load-signaling chamber 52, thereby resulting in maximum signaling pressure at pressure compensator 18. This maximum signaling pressure may be limited to a predetermined value via pressure-limiting valve 104. In this embodiment, the connection of axial bore 94 toward tank chamber 38 is open, in all positions A1 through A3. In positions A1 through A3, secondary chamber 84 is always separated from load-signaling chamber 52, and it may be open toward tank chamber 38.

Figure 2:
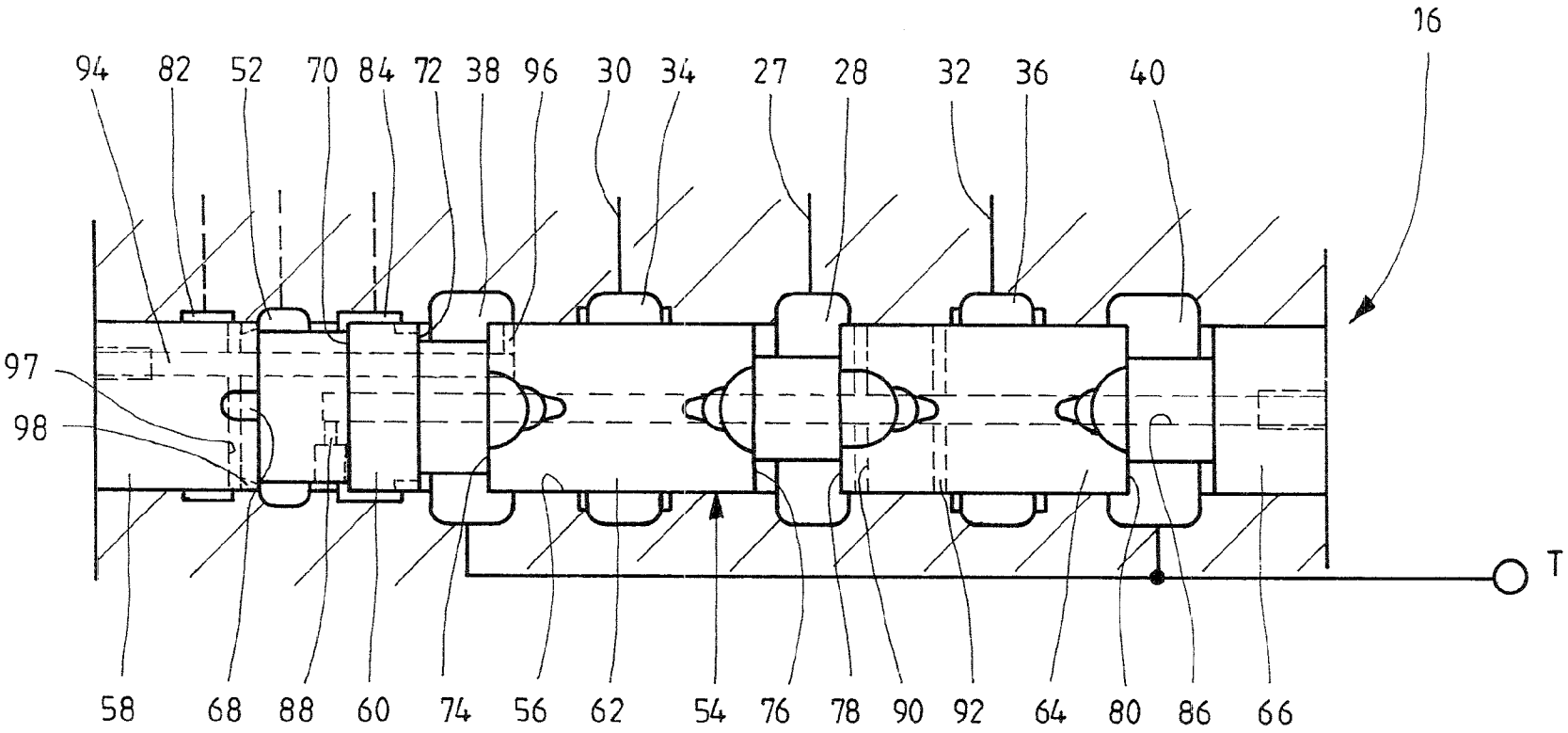
FIG. 2 shows an enlarged view of a directional control valve in FIG. 1.
Figure 4:
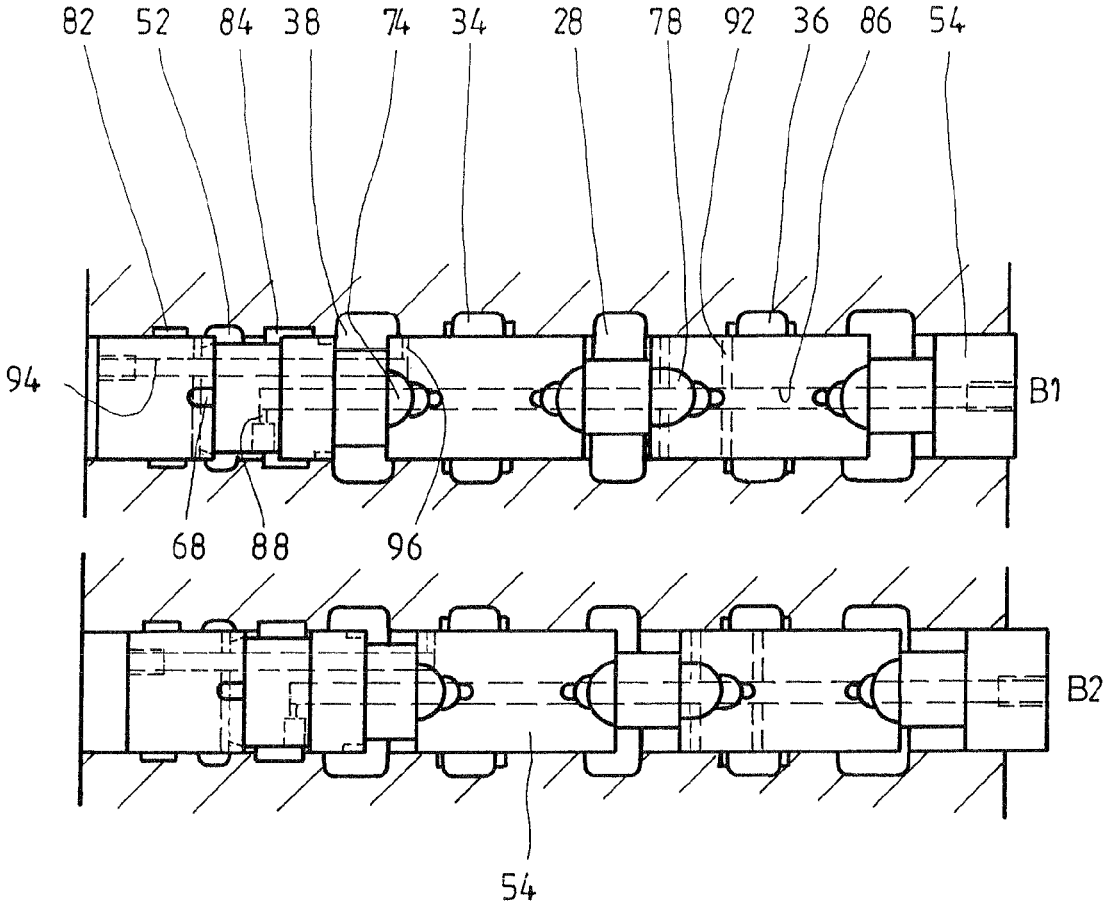
FIG. 4 shows the directional control valve in different positions when displacement occurs in the other direction.

To extend differential cylinder 2, valve spool 54 is displaced from its central position shown in FIGS. 1 and 2 toward the right, e.g., into positions B1 and B2 shown in FIG. 4. First, in position B1, a pressure medium connection is opened via metering orifice control edge 78 between inlet chamber 28 and working chamber 36, which is assigned to working connection B, and a pressure medium connection is opened via tank control edge 74 between working chamber 34 and tank chamber 38, so that pressure medium is conveyed into cylinder chamber 8, and is forced out of annular space 4 toward tank T. Via the displacement of valve spool 54 to the right, tapping bore 92 is opened toward inlet chamber 36, thereby enabling the load pressure downstream of the inlet metering orifice (determined via metering orifice control edge 92) to be tapped and signaled in signaling channel 86. Signaling channel 86 is open via nozzle bore 88 toward secondary chamber 84 and toward load-signaling chamber 52. A fluid connection does not exist between load-signaling chamber 52 and left-hand secondary chamber 82. Radial leg 96 is covered by the segment between tank chamber 38 and working chamber 34, thereby blocking axial bore 94 toward tank chamber 38. Accordingly, in position B1, a signaling pressure that corresponds to the load pressure in working chamber 36 is signaled via tapping bore 92, signaling channel 86, nozzle bore 88, secondary chamber 84, load-signaling chamber 52, and LS channel 50 to the control surface of pressure compensator 18, which is effective in the opening direction; this load-pressure signaling sign corresponds to that of conventional systems. This signaling pressure may be limited via a suitable setting of pressure-limiting valve 106 in second load-signal channel 102, which is always connected to secondary chamber 84.

In end position B2 of valve spool 54, nothing changes in terms of tapping the signaling pressure, thereby allowing the designs for position B1 to be transferred to position B2. In position B2, the maximum pressure medium volumetric flow is directed into cylinder chamber 8, which is increasing in size, and differential cylinder 2 is therefore ejected at maximum speed.

LS valve is used together with an LS pump and LS pressure compensator 18. The pressure compensator Δp is slightly less than the pump Δp. The pressure compensator therefore adjusts a pressure in line 27 that is higher by the pressure equivalent of spring 48 than the pressure in line 50 and in load-signaling chamber 52. When the valve spool is in positions A1, A2 and A3, this pressure exists in a pressure divider between an inlet-side throttle sequence and an outlet-side throttle sequence. The latter is formed by grooves 98, bore 97, bore 94, and bore 96, the throttle effect being determined essentially by grooves 98 when they are active in this manner starting at position A2. The inlet-side throttle sequence is formed by bore 90, bore 86, and bore 88, the throttle effect being determined essentially by bore 88.

A constant oil flow flows from inlet chamber 2R toward tank chamber 38 via the pressure divider. Namely, the pressure drop between chambers 28 and 52 is held constant by pressure compensator 18. Since this throttle cross-section also remains constant, at least when bore 96 is open so far that only bore 88 determines the throttle cross-section of the inlet-side throttle sequence. A constant pressure differential and a constant flow area result in a constant oil flow. This constant oil flow now flows via outlet-side throttle sequence toward tank chamber 38, and generates—depending on the effective throttle cross-section—a pressure differential between chambers 52 and 38. The throttle cross-section is initially large and constant (see position A1). A lower pressure results in line 27, which is not influenced by the load-lowering valve when the pressure falls under load. As soon as grooves 98 become effective, the throttle cross-section changes with the displacement of the valve spool, and a high pressure can be built up.

The present invention makes it possible to manufacture an LS control system using a minimum of outlay in terms of devices and production engineering, it being possible to effectively or at least largely reduce the oscillation tendency that occurs when a load is lowered, via the load pressure, which is dependent on the displacement.

According to the embodiments presented above, a pressure control exists when the cylinder (pulling load) retracts, the signaling pressure that acts on pressure compensator 18 via a pressure divider situated between inlet chamber 28 and tank chamber 38 being changeable via the displacement of valve spool 54. When differential cylinder 2 is extended, a volumetric flow control exists, and the signalling pressure is tapped downstream of the inlet metering orifice.

In the embodiment described above, the load-signaling takes place in load-signalling chamber 52 via channels that are integrated in the valve spool; basically, a portion of the channels could also be formed in the housing of the valve spool.

An LS control system is disclosed that includes an inlet metering orifice and a pressure compensator, via which the pressure drop across the inlet metering orifice may be held constant. The signaling pressure that acts on the pressure compensator in the opening direction may be varied as a function of the displacement in order to prevent the system from oscillating if a negative load should occur.

| Reference numerals: | |
|---|---|
| 1 | Control system |
| 2 | Differential cylinder |
| 4 | Annular chamber |
| 6 | Working line |
| 8 | Cylinder chamber |
| 10 | Working line |
| 12 | Load-lowering valve |
| 14 | Load-lowering line |
| 16 | Directional control valve |
| 18 | Pressure compensator |
| 20 | Pump compensator |
| 22 | Pressure line |
| 24 | Variable-displacement pump |
| 26 | Pump line |
| 27 | Inlet channel |
| 28 | Inlet chamber |
| 30 | Flow channel |
| 32 | Return channel |
| 34 | Working chamber |
| 36 | Working chamber |
| 38 | Tank chamber |
| 40 | Tank chamber |
| 42 | Outlet channel |
| 44 | Tank line |
| 46 | Tank |
| 48 | Control spring |
| 50 | LS channel |
| 52 | Load-signalling chamber |

-continued

| Reference numerals: | |
|---|---|
| 54 | Valve spool |
| 56 | Valve bore |
| 58 | End collar |
| 60 | LS collar |
| 62 | Control collar |
| 64 | Control collar |
| 66 | End collar |
| 68 | Control groove |
| 70 | LS control edge |
| 72 | LS control edge |
| 74 | Tank control edge |
| 76 | Metering orifice control edge |
| 78 | Metering orifice control edge |
| 80 | Tank control edge |
| 82 | Secondary chamber |
| 84 | Secondary chamber |
| 86 | Signalling channel |
| 88 | Nozzle bore |
| 90 | Tapping bore |
| 92 | Tapping bore |
| 94 | Axial bore |
| 96 | Radial leg |
| 97 | Through-bore |
| 98 | Throttle groove |
| 100 | 1st load-signal channel |
| 102 | 2nd load-signal channel |
| 104 | Pressure-limiting valve |
| 106 | Pressure-limiting valve |

What is claimed is:

1. A load-signaling (LS) control system for supplying pressure medium to a hydraulic consumer that includes a continually adjustable directional control valve (16) that forms metering orifices situated in the inlet and/or outlet of the pressure medium, at least one pressure compensator (18) being assigned to at least one metering orifice, the pressure compensator (18) being acted upon by a control pressure to increase the cross section of the opening, the control pressure being tapped via an LS channel (50) by a load-signaling chamber (52) of the directional control valve (16), which is connected via a signaling channel (86) to a pressure chamber that is connected to one of the directional control valve connections (P, A, B), and which is connectable via a throttle cross section (98) to a pressure medium recess (T), it being possible to change the throttle cross section (98) as a function of the displacement of a valve spool (54) of the directional control valve (16), wherein the signaling channel (86) is connectable in one displacement direction to an inlet chamber (28), which is connected to a pressure connection (P), and, in the other displacement direction, to a working chamber (36), which is connected to a working connection (B), and wherein the outlet-side control fluid path includes an axial bore (94) and two radial bores (96, 97) in the valve spool (54), one of which may be opened toward a tank chamber (38), and the other of which may be opened toward the load-signaling chamber (52).

2. The load-signaling control system as recited in claim 1, wherein the load signaling chamber(52) is connectable via an inlet-side control fluid path (90, 86, 88), with an unchangeable throttle effect, to the inlet chamber (28).

3. The load-signaling control system as recited in claim 2, wherein the inlet-side control fluid path includes a signaling bore (86) and two radial bores (90, 88) in the valve spool (54), one of which is open to or may be connected to the inlet chamber (28), and the other of which is open to or may be connected to the load-signaling chamber (52).

4. The load-signaling control system as recited in claim 1, wherein the signaling bore (86) of the inlet-side control fluid path is located in the center of the valve spool (54), and the axial bore (94) in the outlet-side control fluid path is located eccentrically in the valve spool (54).

5. The load-signaling control system as recited in claim 1, wherein the connection of the load-signaling chamber (52) to the pressure medium recess (T) may be opened when displacement takes place in the opposite direction.

6. The load-signaling control system as recited claim 1, wherein the signaling channel (86) is formed, in sections, by a longitudinal bore in which at least two axially interspaced, radial tapping bores (90, 92) lead, one of which may be brought into a pressure medium connection with the inlet chamber (28) depending on the direction of displacement, and the other of which may be brought into a pressure medium connection with the working chamber (36).

7. The load-signaling control system as recited in claim 6, wherein the two tapping bores (90, 92) are formed on a piston collar (64) on which a metering orifice control edge (78) is formed to adjust the opening cross-section of the metering orifice as a function of the displacement in the opposite direction.

8. The load-signaling control system as recited in claim 6, wherein the longitudinal bore is connected, on the other side, via a radially extending nozzle bore (88) to the load-signaling chamber (52) of the directional control valve (16).

9. The load-signaling control system as recited in claim 1, which includes a first and a second secondary chamber (82, 84) which are situated on either side of the load-signaling chamber (52), and which are connected to a first and second load-signaling channel (100, 102), in each of which preferably at least one LS pressure-limiting valve (104, 106) is situated.

10. The load-signaling control system as recited in claim 9, wherein two control grooves (68, 70) are formed on the valve spool (54), via which a connection may be established between the load-signaling chamber (52) and an adjacent secondary chamber (82) to the other secondary chamber (84).

11. The load-signaling control system as recited in claim 10, which includes further control groove (72) for establishing a connection between a tank chamber (38) and the adjacent secondary chamber (84).

12. The load-signaling control system as recited claim 1, further comprising a first secondary chamber (82) arranged on one side of the load-signaling chamber (52) and a second secondary chamber (84) arranged on another side of the load-signaling chamber (52), wherein one of said radial bores (97) is connectable to the first secondary chamber (82) via a throttle cross-section that is changeable depending on the displacement, in particular a throttle groove (98).

* * * * *